United States Patent [19]

Grevemeyer

[11] Patent Number: 4,867,125

[45] Date of Patent: Sep. 19, 1989

[54] AIR/FUEL RATIO CONTROL SYSTEM

[75] Inventor: Bryce Grevemeyer, Livonia, Mich.

[73] Assignee: Ford Motor Company, Dearborn, Mich.

[21] Appl. No.: 246,833

[22] Filed: Sep. 20, 1988

[51] Int. Cl.[4] ..... F02M 51/00

[52] U.S. Cl. ..... 123/489; 123/440

[58] Field of Search ..... 123/440, 489, 478, 480, 123/416, 417

[56] References Cited

U.S. PATENT DOCUMENTS

| | | | |
|---|---|---|---|
| 4,363,305 | 12/1982 | Ohgami et al. | 123/440 |
| 4,375,796 | 3/1983 | Ohgami et al. | 123/440 |
| 4,378,773 | 5/1983 | Ohgami | 123/440 |
| 4,386,592 | 6/1983 | Ohgami et al. | 123/440 |
| 4,397,279 | 8/1983 | Iida | 123/440 |
| 4,402,291 | 9/1983 | Aono | 123/440 |
| 4,402,292 | 9/1983 | Ohgami et al. | 123/440 |
| 4,402,293 | 9/1983 | Ohgami | 123/440 |
| 4,503,828 | 3/1985 | Ohgami et al. | 123/489 |
| 4,526,001 | 7/1985 | Burns et al. | 60/274 |
| 4,723,522 | 2/1988 | Samuel | 123/489 |
| 4,759,332 | 7/1988 | Morozumi | 123/489 |
| 4,766,870 | 8/1988 | Nakajima et al. | 123/489 |
| 4,787,357 | 11/1988 | Nishikawa et al. | 123/489 |
| 4,800,857 | 1/1989 | Tomisawa | 123/489 |

*Primary Examiner*—Raymond A. Nelli

*Attorney, Agent, or Firm*—Allan J. Lippa; Peter Abolins

[57] ABSTRACT

An apparatus and method for adjusting the air/fuel ratio inducted into an internal combustion engine to achieve a desired air/fuel ratio. A desired fuel charge is first derived from a measurement of inducted airflow and then modulated with a triangular wave. The actual deviation of the mean value of the triangular wave from the desired air/fuel ratio is calculated. More specifically, the ratio of time the modulated signal is offset from the desired air/fuel ratio is trigonometrically related to the actual deviation. This time ratio is derived from a two-state (rich/lean) signal which is provided by comparing an exhaust gas oxygen sensor voltage output to a reference value. In response to the deviation calculation, the desired fuel charge signal is shifted to zero in on the desired air/fuel ratio.

22 Claims, 5 Drawing Sheets

AIR/FUEL RATIO CONTROL SYSTEM

BACKGROUND

The field of the invention relates to air/fuel ratio control of the mixture of air and fuel inducted into an internal combustion engine.

It is desired to maintain the air/fuel ratio at a predetermined or desired level within the operating window of conventional three-way (HC, CO, $NO_x$) catalytic converters. Typically, conventional catalytic converters operate most efficiently when the air/fuel ratio is near 14.17 lbs. air/1 lb. fuel, a condition referred as stoichiometry.

Exhaust gas oxygen sensors (EGO) are commonly employed in feedback loops to regulate the air/fuel ratio about stoichiometry. Since the EGO sensor voltage output is only proportional to actual air/fuel ratio in a narrow region at stoichiometry, those prior approaches which have attempted to measure the actual air/fuel ratio directly from the EGO sensor voltage output have limited effectiveness. Although proportional exhaust gas oxygen sensors have been proposed wherein the sensor output is proportional to the actual air/furel ratio over a wide region around stoichiometry, these proportional devices are prohibitively expensive. Accordingly, typical approaches compare the conventional EGO sensor output to a reference associated with stoichiometry. A two-state switching device is thereby created for providing an indication of whether the air/fuel ratio is either on the rich side or the lean side of stoichiometry.

One known air/fuel ratio control system which employs such a two-state device is referred to as Ramp and Jumpback. In a typical example, the air/fuel mixture is gradually increased, or ramped, to the rich side until the EGO sensor detects a transition from a lean to a rich air/fuel ratio. The air/fuel ratio is then jumped to the lean side and ramped lean until the EGO sensor detects a transition from rich to lean. The process continues, ramping in alternating directions, resulting in an average excursion about stoichiometry.

The inventor herein has recognized that a problem with the above and similar approaches is that the air/fuel ratio continues to be ramped away from stoichiometry for a considerable time after the air/fuel mixture actually crosses stoichiometry. This is due to the time delay of an air/fuel charge through the intake manifold, engine, exhaust manifold, and EGO sensor. Besides causing emission and driveability problems, these excursions may saturate the EGO sensor further slowing the system response time.

U.S. Pat. No. 4,378,773 issued to Ohgami discloses a feedback control signal responsive to an EGO sensor wherein the air/fuel mixture is dithered to define three regions. More specifically, the air/fuel mixture is dithered six times per cycle such that there are two large rich excursions, one small rich excursion, two large lean excursions, and one small lean excursion. By counting the number of excursions detected by the EGO sensor, it may be determined whether stoichiometry is in one of the three regions. A disadvantage with this approach is that, apparently, operation is not centered or zeroed on stoichiometry.

U.S. Pat. No. 4,402,291 issued to Aono discloses another air/fuel ratio control system responsive to an exhaust gas oxygen sensor. The EGO sensor output is modulated with a bipolar signal to reduce the excursions in air/fuel ratios. A disadvantage of this system also appears to be that air/fuel operation is not zeroed on stoichiometry.

SUMMARY OF THE INVENTION

An object of the invention is to provide a fuel control system for operating an internal combustion engine with minimal average air/fuel ratio excursions from a desired air/fuel ratio.

The above object is achieved, problems and disadvantages of prior approaches overcome, and additional advantages achieved by providing both an apparatus and method for adjusting the actual air/fuel ratio of an air/fuel mixture inducted into an internal combustion engine so that the actual air/fuel ratio approximates the desired air/fuel ratio. In one particular aspect of the invention, a method includes the steps of: measuring the airflow inducted into the engine; calculating a desired fuel flow signal related to the desired air/fuel ratio in response to the airflow measurement; modulating the desired fuel flow signal with a preselected periodic signal to generate a modulated desired fuel flow signal; delivering fuel into the engine in relation to the modulated desired fuel flow signal; providing an indication of the oxygen content in the engine exhaust; comparing the desired air/fuel ratio to the oxygen indication for providing an offset signal having a first offset state related to a rich offset of the oxygen content and a second offset state related to a lean offset of the oxygen content from the desired air/fuel ratio; calculating the percentage of time one of the offset signals occurs during a single cycle of the preselected signal; translating the percentage time offset into a deviation measurement of the actual air/fuel ratio from the desired air/fuel ratio; and correcting the desired fuel flow signal in response to the deviation measurement so that the actual air/fuel ratio approximates the desired air/fuel ratio. Preferably, the periodic signal comprises a triangular wave such that the percentage time offset is linearly related to the deviation of the mean value of the triangular wave from the desired air/fuel ratio.

After the correction step described above is performed, the mean triangular wave value zeroes in on the desired air/fuel ratio. Accordingly, an advantage is obtained of having average air/fuel operation at the desired air/fuel ratio with minimal, and preselected, excursions from the desired air/fuel ratio. That is, since the air/fuel ratio is modulated by a preselected periodic signal, any excursion from the desired air/fuel ratio is predetermined by selection of the periodic signal. On the other hand, in some prior approaches, air/fuel ratio excursions continued until the EGO sensor switched after a time delay through the engine and exhaust. Still another advantage is that the limited and preselected excursions from a desired air/fuel ratio (such as stoichiometry) avoids saturation of the EGO sensor, and catalytic converter, resulting in improved air/fuel ratio control and reduced emissions. Another advantage, is that by utilizing a simple two-state signal (comparison of exhaust oxygen to desired air/fuel ratio), simple and accurate air/fuel ratio control is maintained. Stated another way, it is known that EGO output is often either chopped or at least not linearly related to actual air/fuel ratio when the actual air/fuel ratio varies from stoichiometry. It is also known that the EGO output waveform has considerable noise components and is adversely affected by temperature. Thus, the shortcomings of some prior approaches which assumed that the EGO output waveform is proportional to actual air/fuel ratio over a wide region around stoichiometry are avoided by the invention claimed herein. Still another advantage is that the aspect of the invention described above actually zeroes in on a desired air/fuel ratio, and does so whether or not a desired air/fuel ratio is at stoichiometry.

In another aspect of the invention, the gain of the modulated signal is varied to prevent the desired air/fuel ratio from falling outside of the bandwidth of the modulated signal. The gain is also varied to minimize air/fuel ratio excursions around the desired air/fuel ratio by adjusting the gain in relation to the deviation measurement. More specifically, the number of cycles of the preselected periodic signal is counted since the last transition of the offset state of the offset signal. When the number of cycles is below a predetermined number, the gain of the modulated signal is increased to capture the desired air/fuel ratio within the bandwidth of the modulated signal. Afterwards, the bandwidth is varied in relation to the deviation measurement to minimize excursions from the desired air/fuel ratio. An advantage is thereby obtained of minimizing excursions in air/fuel ratio from the desired air/fuel ratio, while maintaining a desired air/fuel ratio within the bandwidth of the modulated signal.

BRIEF DESCRIPTION OF THE DRAWINGS

The above objects and advantages, and additional advantages, will be better understood upon reading the following description of the preferred embodiment in relation to the drawings, wherein.

DESCRIPTION OF THE PREFERRED EMBODIMENT

Figure 1:
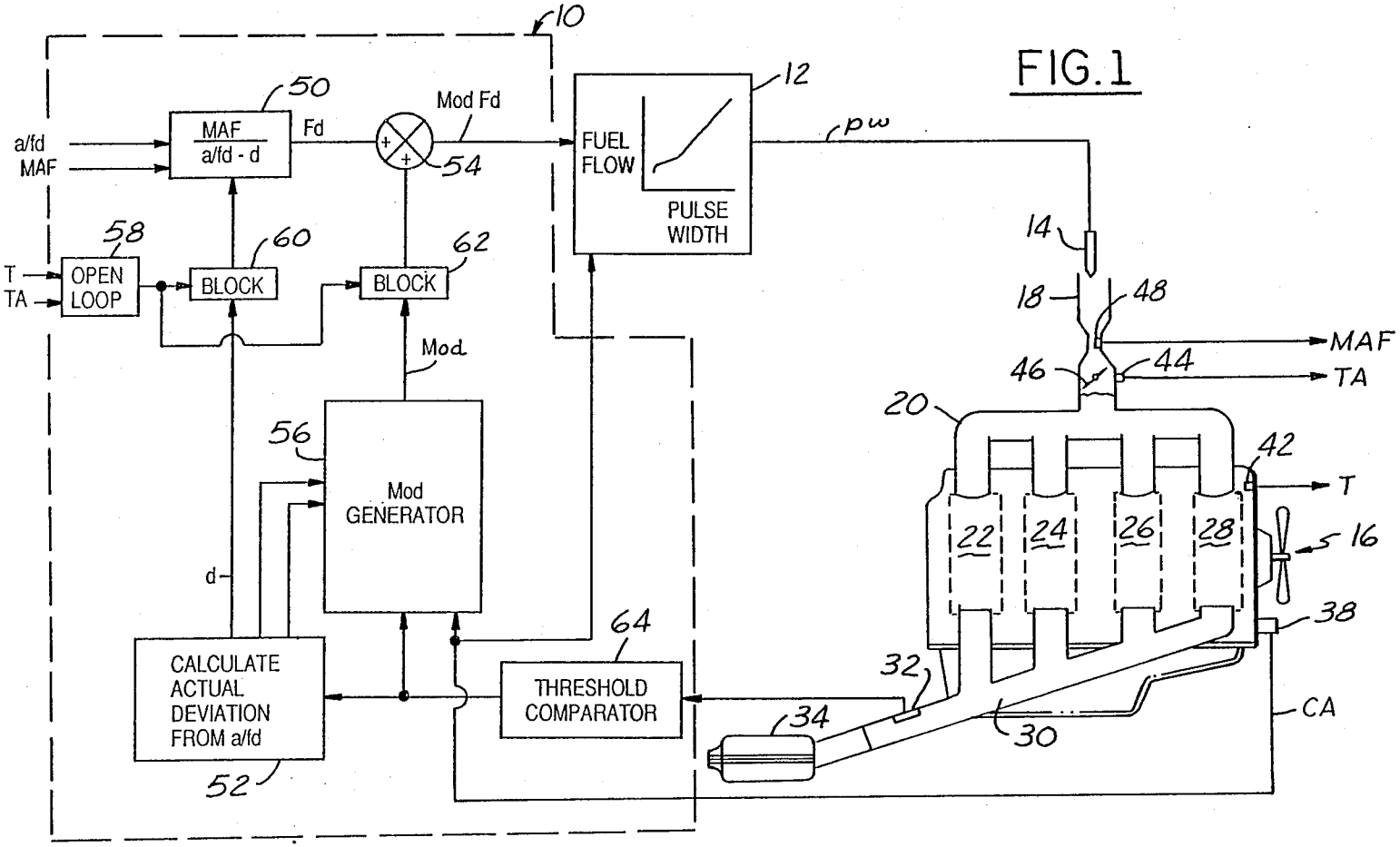
FIG. 1 is a block diagram of an embodiment in which the invention is used to advantage.

Referring to FIG. 1, fuel control system 10 is shown providing fuel control signal (ModFd) to conventional fuel injector controller 12 for actuating fuel injector 14. In the example presented herein, fuel injector 14 is coupled to internal combustion engine 16 via intake 18 and manifold 20. Internal combustion engine 16 is shown further including combustion chambers 22, 24, 26, and 28 receiving a mixture of air and fuel from manifold 20 and expelling exhaust gases through exhaust manifold 30. Exhaust gas oxygen sensor (EGO) 32 and conventional three-way (HC, CO, $NO_x$) catalytic converter 34 are shown coupled to exhaust manifold 30. Additional conventional sensors include: crank angle detector 38 coupled to the crankshaft for generating signal CA; temperature sensor 42 coupled to the cooling system for generating temperature signal T; throttle angle sensor 44 coupled to throttle plate 46 for generating throttle angle signal TA; and mass airflow sensor 48 coupled to intake 18 for generating signal MAF related to the mass airflow inducted into the combustion chambers.

It is noted that numerous conventional engine components are not shown in FIG. 1 because they are well known and a detailed description is not necessary for an understanding of the invention. For example, the ignition control system and associated spark plugs are not shown. Further, the conventional fuel system, including a fuel tank coupled to fuel injector 14 via a fuel pump and fuel rail are not shown. It is also noted that the invention is not limited to the four cylinder CFI (central fuel injection) system shown, but may be used to advantage with any size engine and any type of fuel system such as multiport fuel injection or carbureted systems.

In general terms, which are described in greater detail hereinafter with particular reference to FIGS. 3A and 3B, 4A and 4B, fuel control system 10 is here shown including desired fuel flow generator 50 which is responsive to signal MAF, desired air/fuel ratio signal a/fd, and deviation signal d from correction controller 52. Deviation signal d is a feedback signal which is a measurement of the deviation between actual air/fuel ratio and desired air/fuel ratio (a/fd). In response to deviation signal d, desired fuel flow generator 50 shifts the desired fuel flow calculation of signal fd such that the fuel delivered to engine 16 results in an actual air/fuel ratio which is zeroed in on the desired air/fuel ratio.

Modulator or adder 54 is shown adding desired fuel flow (Fd) to modulation signal Mod, a triangular wave from modulation generator 56 in this example, thereby forming modulated desired fuel flow signal ModFd. Signal ModFd is converted by fuel injection controller 12 into pulse signal pw, via a map or look up table such that the fuel delivered by fuel injector 14 is approximately equal to the modulated desired fuel flow.

Before describing fuel control system 10 in specific detail, its open loop operation is first described with reference to FIG. 1. For the example presented herein, feedback air/fuel ratio control is disabled and open loop operation enabled during either full engine throttle, or low temperature operation. More specifically, in response to either signal T or signal TA, open loop generator 58 disables deviation signal d and modulation signal Mod via block circuitry 60 and 62, respectively. Accordingly, desired fuel flow generator 50 divides MAF by a/fd to generate Fd. With modulation signal Mod blocked by block circuitry 62, signal Fd is coupled through adder 54 to fuel injection controller 12. Thus, in open loop operation, fuel delivered by fuel injector 14 is dependent only upon MAF and a/fd.

Figures 2A, 2B:
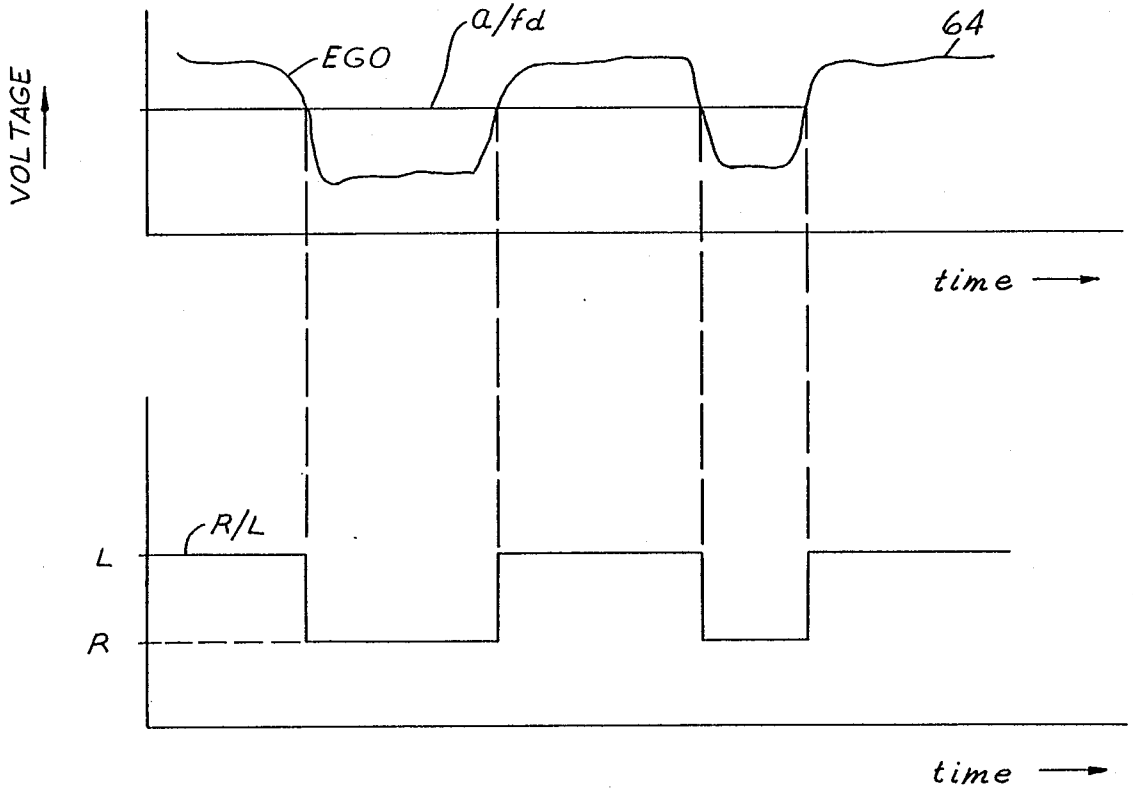
FIGS. 2A and 2B are graphical representations of electronic waveforms associated with some components illustrated in FIG. 1.

Closed loop operation of fuel control system 10 is now described in general terms. EGO sensor 32 provides an indication of the oxygen content in the exhaust of engine 16 as shown by electrical waveform 64 in FIG. 2A. It is noted that waveform 64 is closely correlated with oxygen content only around the desired air/fuel ratio (a/fd) which is here shown as stoichiometry (14.7 lbs air/1 lb fuel). As illustrated in FIG. 2, waveform 64 becomes nonlinear, and also chopped or limited, as the exhaust gas composition varies from stoichiometry. Accordingly, in the example illustrated herein, the output of EGO 32 is compared to a/fd in threshold comparator 68 to generate two-state signal R/L (rich/lean) as shown in FIG. 2B. When the exhaust gases are on the lean side of stoichiometry, R/L is shown in the high or lean (L) state. Conversely, when exhaust gases are on the rich side of stoichiometry, R/L is shown in the low or rich (R) state.

Figure 3A:
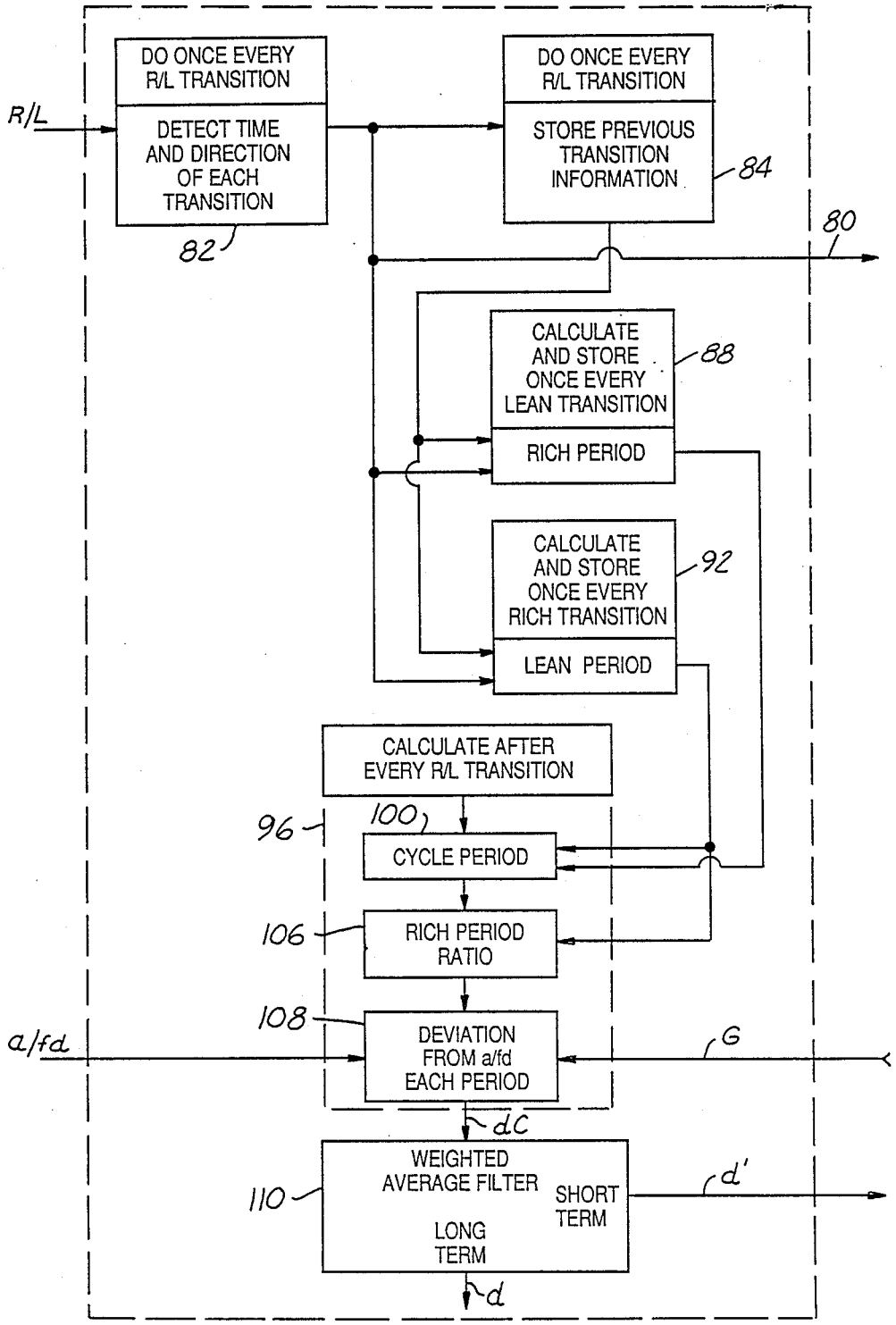
FIGS. 3A and 3B show a more detailed electronic block diagrams of corresponding components shown in FIG. 1.
Figure 3B:
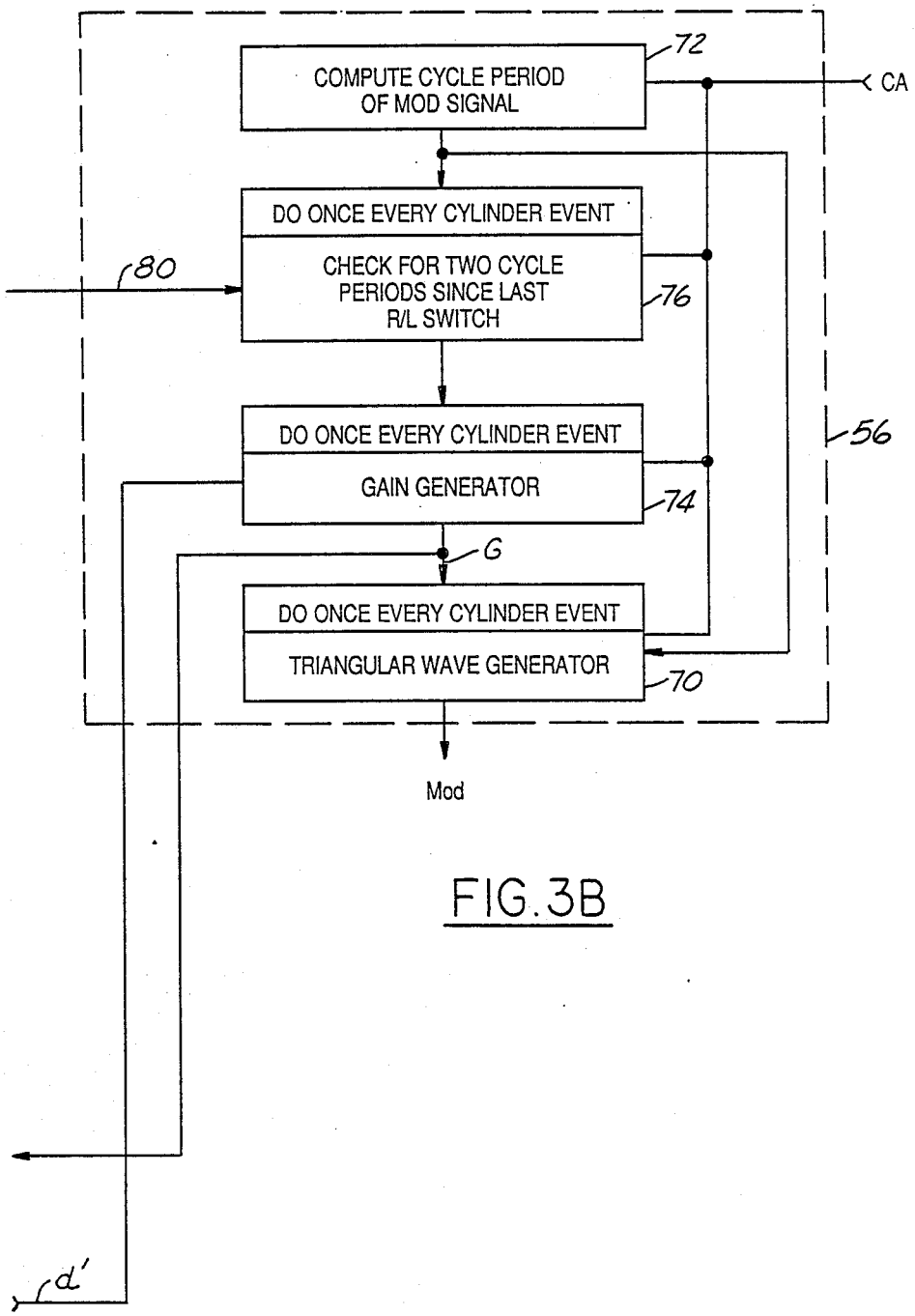
Figure 4A:
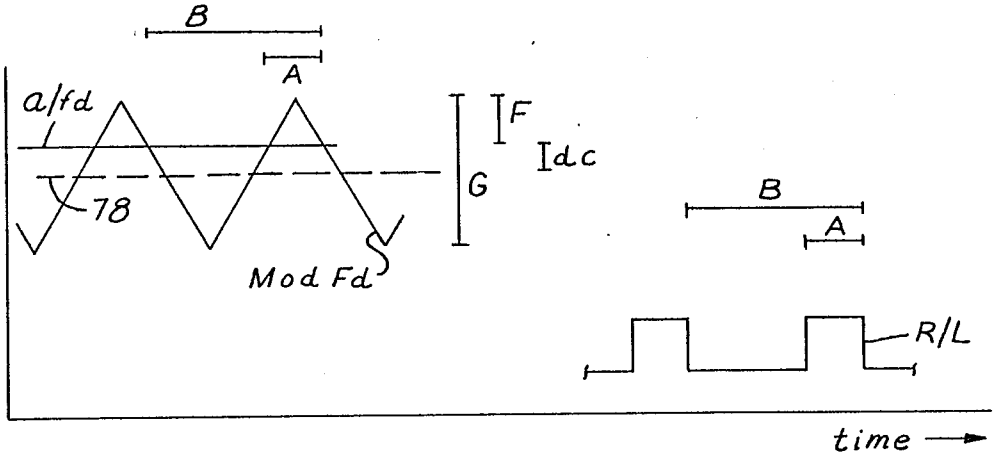
FIGS. 4A and 4B are graphical representations of various electronic waveforms associated with FIGS. 3A and 3B.
Figure 4B:
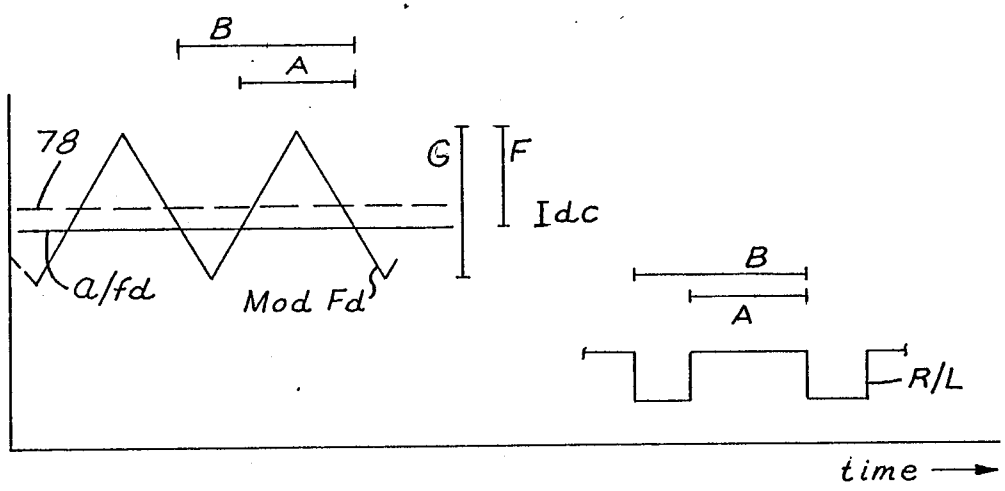

A more detailed description of fuel control system 10 is now provided with reference to the block diagram of FIGS. 3A and 3B and associated electrical waveforms shown in FIGS. 4A and 4B. For the example shown herein, triangular wave generator 70 of Mod signal generator 56 generates signal Mod in response to cycle period generator 72 and gain generator 74. Cycle period generator 72 generates a cycle period once every $2\frac{1}{2}$ engine revolutions such that five combustion chambers fire once per cycle period of signal Mod. Stated another way, there are five cylinder events once per cycle period. Gain generator 74 determines the gain or bandwidth of signal Mod during two operating conditions—capture and normal. During capture operation, transition counter 76 generates an out of bound signal when two cycles of signal Mod have elapsed since the last R/L switch. If such R/L switch has not occurred, the gain of signal Mod is increased to capture a/fd. R/L switching information is provided on line 80 from transition detector 82 as described in greater detail later herein. During normal operation, the gain of signal Mod is adjusted in direct proportion to a weighted average (d') of the calculated deviation (d) of the mean value of signal Mod from a/fd. In the example presented herein, gain generator 74 generates the gain at four times d'. However, the gain is prevented from falling below a minimum preselected value, otherwise the gain would fall to zero as fuel control system 10 zeroes in on stoichiometry.

The structure and operation of air/fuel ratio correction controller 52 is now described with particular reference to the block diagram shown in FIGS. 3A and 3B and associated electrical waveform shown in FIGS. 4A and 4B. An example of operation is shown in FIG. 4A wherein the mean value of signal Mod (line 78) is below a/fd. Similarly, another example of operation is presented in FIG. 4B wherein the mean value of signal Mod is above a/fd.

Referring first to FIG. 4A, in general terms, signal Mod is shown having a peak-to-peak bandwidth G. The deviation of the mean value of signal Mod from a/fd over a single cycle of signal Mod is shown by the value dc. Value F is shown as the difference in amplitude between the peak vaue of signal Mod and a/fd. The time duration during which signal Mod is above, or lean, of af/d is shown by value A. One cycle period of signal Mod is shown by value B. As described in greater detail hereinafter, time values A and B are measured directly from transitions in signal R/L a predetermined time delay after the fuel charge corresponding to these A and B values has propagated through engine 16 to EGO sensor 32. By the law of similar triangles, $A/B=F/G$. Signal dc is therefore equal to $G(\frac{1}{2}-A/B)$ as follows: $dc=G/2-F=G/2-G\ A/B=G(\frac{1}{2}-A/B)$. Thus, knowing gain G and measuring time ratio A/B, the deviation (dc) from a/fd is solved for. Deviation dc is then averaged in weighted average filter 110 to generate deviation signal d. With deviation signal d determined, desired fuel charge Fd is appropriately corrected or shifted in desired fuel flow generator 50 such that the mean value of ModFd is zeroed in an a/fd.

Referring back to FIGS. 3A and 3B, a more detailed description of air/fuel ratio correction controller 52 is now provided for performing the operations described hereinabove. Transition detector 82 detects and stores the time and direction of each transition or switch of signal R/L to generate signal $Dt_i$. When transitions are detected, the previous transition information is transferred to transition storage 84 to generate signal $Dt_{i-1}$. On each lean transition of signal R/L, rich period calculator 88 calculates and stores the current rich period by subtracting the current transition time stored in transition detector 82 ($Dt_i$) from the previous transition time stored in transition storage 84 ($Dt_{i-1}$). Similarly, on each R/L rich transition, lean period calculator 92 subtracts the current transition time stored in transition detector 82 from the previous transition time stored in transition storage 84. This value was designated as value A in the previous example.

Referring now to air/fuel ratio deviation detector 96, cycle period calculator 100 adds the values stored in rich period calculator 88 and lean period calculator 92 to generate the cycle period once each transition of signal R/L. The cycle period was designated as value B in the previous example. Rich period ratio detector 106 divides the rich period (A) by the cycle period (B) to generate the rich period ratio (A/B). In response, deviation calculator 108 subtracts the rich period ratio from one-half and multiplies the difference by bandwidth G to compute dc wherein $dc=G(\frac{1}{2}-A/B)$. It is noted that dc is a positive value when the mean of ModFd is below a/fd (i.e., lean as shown in FIG. 4A) and a negative value when the mean is above a/fd (i.e., rich as shown in FIG. 4B). It is also noted that in the example presented above, cycle period B is illustrated as the period between down transitions of signal R/L. However, cycle period B is also calculated for cycle period between up transitions of signal R/L. Thus, the A/B ratio is calculated every half cycle of signal R/L.

Filter 110 averages deviation dc over a long term or long number of cycle periods, eight cycle periods in the example presented herein, to generate deviation signal d. Filter 110 also averages deviation d over a short term or short number of cycle periods, three in this example, to generate deviation signal d' for use by gain generator 74 as previously described herein.

In response to deviation signal d, desired fuel flow generator 50 subtracts d from a/fd and divides the difference into MAF thereby shifting desired fuel flow Fd. Accordingly, Fd is shifted by deviation signal d thereby zeroing the mean of ModFd onto a/fd. Thus, engine 16 operates at an average air/fuel ratio which is at the desired air/fuel ratio (a/fd).

This concludes the description of the preferred embodiment. The reading of it by those skilled in the art will bring to mind many alterations and modifications without departing from the spirit and scope of the invention. For example, modulation signals other than triangular waves may be used to advantage even though the complexity of calculating d would be increased. Accordingly, it is intended that the scope of the invention be limited only by the following claims.

What is claimed:

1. A method for adjusting the actual air/fuel ratio of an air/fuel mixture inducted into an internal combustion engine so that the actual air/fuel ratio approximates a desired air/fuel ratio, said method comprising the steps of:

calculating a desired fuel flow signal related to the desired air/fuel ratio;

modulating the desired fuel flow signal with a preselected signal;

delivering fuel into the engine in relation to the desired fuel flow signal;

providing an indication when the actual air/fuel ratio is offset in one direction from the desired air/fuel ratio;

calculating the percentage of time said offset in one direction occurs during a predetermined number of cycles of said preselected signal;

translating said percentage time offset into a deviation measurement of the actual air/fuel ratio from the desired air/fuel ratio; and correcting said desired fuel flow signal in response to said deviation measurement so that the actual air/fuel ratio is more closely related to the desired air/fuel ratio.

2. The method recited in claim 1 wherein said calculation step calculates the percentage of time said offset occurs in a rich direction from the desired air/fuel ratio.

3. The method recited in claim 1 wherein said calculation step calculates the percentage of time said offset occurs in a lean direction from the desired air/fuel ratio.

4. A method for adjusting the actual air/fuel ratio of an air/fuel mixture inducted into an internal combustion engine so that the actual air/fuel ratio approximates a desired air/fuel ratio, said method comprising the steps of:

measure the airflow inducted into the engine;

calculating a desired fuel flow signal related to the desired air/fuel ratio in response to said airflow measurement;

modulating the desired fuel flow signal with a preselected periodic signal to generate a modulated desired fuel flow signal;

delivering fuel into the engine in relation to said modulated desired fuel flow signal;

providing an indication of the oxygen content in the engine exhaust;

comparing the desired air/fuel ratio to said oxygen indication for providing an offset signal having a first offset state related to a rich offset of said oxygen content and a second offset state related to a lean offset of said oxygen content from said desired air/fuel ratio;

calculating the percentage of time one of said offset signals occurs during a single cycle of said preselected signal;

translating said percentage time offset into a deviation measurement of the actual air/fuel ratio from the desired air/fuel ratio; and correcting said desired fuel flow signal in response to said deviation measurement so that the actual air/fuel ratio approximates the desired air/fuel ratio.

5. The method recited in claim 4 wherein said calculation step calculates the percentage of time said offset occurs in a rich direction from the desired air/fuel ratio.

6. The method recited in claim 4 wherein said calculation step calculates the percentage of time said offset occurs in a lean direction from the desired air/fuel ratio.

7. The method recited in claim 4 further comprising the step of generating said periodic signal with a predetermined cycle period.

8. The method recited in claim 7 wherein said cycle period is generated such that at least each combustion chamber of the engine fires at least once during said cycle period.

9. The method recited in claim 8 wherein said periodic signal comprises a triangular wave.

10. The method recited in claim 9 wherein said deviation measurement is equal one half of to the peak to peak amplitude of said triangular wave less said peak-to-peak amplitude times said percentage time offset.

11. A fuel control system for adjusting the fuel delivered into the intake of an internal combustion engine by a fuel delivery apparatus responsive to an electronic control signal so that the actual air/fuel ratio approximates a desired air/fuel ratio, said apparatus comprising:

control means for generating a desired fuel flow signal related to the desired air/fuel ratio;

modulation means coupled to said control means for modulating the desired fuel flow signal with a preselected periodic signal to generate the electronic control signal;

an exhaust gas oxygen sensor coupled to the engine exhaust for providing an indication of exhaust oxygen content;

comparison means for comparing the desired air/fuel ratio to said oxygen indication to provide an offset signal having a first offset state related to a rich offset of said oxygen content and a second offset state related to a lean offset of said oxygen content from said desired air/fuel ratio;

calculation means responsive to said comparison means for calculating the percentage of time one of said offset signals occurs during a single cycle of said preselected signal;

conversion means responsive to said calculation means for converting said percentage time offset into a deviation measurement of the actual air/fuel ratio from the desired air/fuel ratio; and correction means responsive to said conversion means for correcting said desired fuel flow signal in response to said deviation measurement so that the actual air/fuel ratio is approximately equal to the desired air/fuel ratio.

12. The fuel control system recited in claim 11 further comprising means for generating said periodic signal with a predetermined cycle period and a predetermined peak to peak amplitude. 1

13. The fuel control system recited in claim 12 wherein said periodic signal generating means adjusts said peak-to-peak amplitude in relation to said deviation measurement.

14. The fuel control system recited in claim 12 further comprising transition means for detecting transitions in said offset states of said offset signal.

15. The fuel control system recited in claim 14 further comprising signal means responsive to said transition means for providing an out of band signal when a predetermined number of cycles of said periodic signal have occurred since said detected transition.

16. The fuel control system recited in claim 15 wherein said periodic signal generating means increases said peak-to-peak amplitude of said periodic signal in response to said out of band signal.

17. The fuel control system recited in claim 12 wherein said cycle period is generated such that at least each combustion chamber of the engine fires at least once during said cycle period.

18. The fuel control system recited in claim 17 wherein said periodic signal comprises a triangular wave.

19. The fuel control system recited in claim 18 wherein said deviation measurement is equal to one-half of said peak-to-peak amplitude of said triangular wave less said peak-to-peak amplitude times said percentage time offset.

20. A fuel control system for adjusting the actual air/fuel ratio of an air/fuel mixture inducted into the intake of an internal combustion engine so that the actual air/fuel ratio approximates a desired air/fuel ratio, said apparatus comprising:

an airflow sensor coupled to the intake;

calculation means coupled to said airflow sensor for generating a desired fuel flow signal related to the desired air/fuel ratio;

a signal generator for generating a periodic signal with a periodic cycle period and a predetermined peak to peak amplitude;

modulation means coupled to said calculation means for modulating the desired fuel flow signal with said periodic signal to generate a modulated desired fuel flow signal;

a fuel delivery system coupled to the intake for delivering fuel into the engine in relation to said modulated desired fuel flow signal;

an exhaust gas oxygen sensor coupled to the engine exhaust for providing an indication of exhaust oxygen content;

comparison means for comparing the desired air/fuel ratio to said oxygen indication to provide an offset signal having a first offset state related to a rich offset of said oxygen content and a second offset state related to a lean offset of said oxygen content from said desired air/fuel ratio;

calculation means responsive to said comparison means for calculating the percentage of time one of said offset signals occurs during a single cycle of said preselected signal;

conversion means responsive to said calculation means for converting said percentage time offset into a deviation measurement of the actual air/fuel ratio from the desired air/fuel ratio; and correction means responsive to said conversion means for correcting said desired fuel flow signal in response to said deviation measurement so that the actual air/fuel ratio is approximately equal to the desired air/fuel ratio.

21. The fuel control system recited in claim 20 wherein said periodic signal comprises a triangular wave.

22. The fuel control system recited in claim 21 wherein said deviation measurement is equal to one-half of said peak-to-peak amplitude of said triangular wave less said peak-to-peak amplitude times said percentage time offset.

* * * * *